US006467341B1

(12) United States Patent
Boucher et al.

(10) Patent No.: US 6,467,341 B1
(45) Date of Patent: Oct. 22, 2002

(54) ACCELEROMETER CALIPER WHILE DRILLING

(75) Inventors: Marcel Boucher, Houston, TX (US); Brian Peter Jarvis, Chipping Sodbury (GB); Tim McCarthy, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/841,659

(22) Filed: Apr. 24, 2001

(51) Int. Cl.[7] ..... E21B 47/08; E21B 47/00; G01V 1/00; G01B 21/20

(52) U.S. Cl. ..... 73/152.43; 73/152.46; 166/254.2; 175/45

(58) Field of Search ..... 73/152.43, 152.46, 73/152.48, 152.03; 175/45, 49, 50; 166/254.2, 255.2, 250.1

(56) References Cited

U.S. PATENT DOCUMENTS

| | | | | |
|---|---|---|---|---|
| 1,819,923 A | | 8/1931 | Schlumberger | 73/152.02 |
| 1,913,293 A | | 6/1933 | Schlumberger | 73/152.02 |
| 2,476,137 A | | 7/1949 | Doll | 166/21 |
| 2,524,031 A | | 10/1950 | Arps | 255/1 |
| 2,573,137 A | | 10/1951 | Greer | 175/182 |
| 2,677,790 A | | 5/1954 | Arps | 324/1 |
| 2,925,251 A | | 2/1960 | Arps | 255/1.8 |
| 3,058,532 A | | 10/1962 | Alder | 175/39 |
| 3,345,867 A | | 10/1967 | Arps | 73/152.47 |
| 3,455,158 A | | 7/1969 | Richter, Jr. et al. | 73/152.03 |
| 4,095,865 A | | 6/1978 | Denison et al. | 339/16 R |
| 4,216,536 A | | 8/1980 | More | 367/83 |
| 4,324,297 A | | 4/1982 | Denison | 175/45 |
| 4,346,591 A | | 8/1982 | Evans | 73/152.55 |
| 4,445,578 A | | 5/1984 | Millheim | 175/45 |
| 4,445,734 A | | 5/1984 | Cunningham | 339/16 C |
| 4,455,278 A | | 6/1984 | van Nederveen et al. | 419/6 |
| 4,496,203 A | | 1/1985 | Meadows | 339/16 C |
| 4,518,888 A | | 5/1985 | Zabcik | 310/334 |
| 4,557,538 A | | 12/1985 | Chevalier | 339/16 C |
| 4,599,904 A | * | 7/1986 | Fontenot | 73/783 |
| 4,662,458 A | | 5/1987 | Ho | 175/27 |
| 4,697,650 A | * | 10/1987 | Fontenot | 175/50 |
| 4,788,544 A | | 11/1988 | Howard | 340/853 |
| 4,829,489 A | | 5/1989 | Rector | 367/82 |
| 4,884,071 A | | 11/1989 | Howard | 340/854 |
| 4,903,245 A | | 2/1990 | Close et al. | 367/81 |
| 4,914,433 A | | 4/1990 | Galle | 340/854 |
| 4,958,125 A | | 9/1990 | Jardine et al. | 324/162 |

(List continued on next page.)

FOREIGN PATENT DOCUMENTS

| | | |
|---|---|---|
| EP | 0558379 B1 | 5/1996 |
| EP | 0728915 A2 | 8/1996 |
| WO | WO98/17894 A2 | 4/1998 |
| WO | WO99/36801 A1 | 7/1999 |

OTHER PUBLICATIONS

Leggett III; Dubinsky; Patterson; Bolshakov; "Field Test Results Demonstrating Improved Real–Time Data Quality in an Advanced LWD Acoustic System"; SPE 71732; 2001 SPE Annual Technical Conference and Exhibition held in New Orleans, Louisiana, Sep. 30–Oct. 3, 2001. English.

*Primary Examiner*—Hezron Williams
*Assistant Examiner*—David J. Wiggins
(74) *Attorney, Agent, or Firm*—Jeffery E. Daly

(57) ABSTRACT

An accelerometer caliper while drilling arrangement comprising a drill bit having an axis of rotation and a gauge region, a caliper tool body, a first accelerometer mounted upon the caliper tool body and arranged to measure acceleration in a first direction, and a second accelerometer mounted upon the caliper tool body and arranged to measure acceleration in a second direction orthogonal to the first direction, wherein the caliper tool body and the drill bit are coupled to one another in such a manner that the first and second accelerometers are mounted in a known relationship to the drill bit.

9 Claims, 2 Drawing Sheets

U.S. PATENT DOCUMENTS

| | | | | | |
|---|---|---|---|---|---|
| 4,958,517 | A | | 9/1990 | Maron | 73/152.46 |
| 5,058,077 | A | | 10/1991 | Twist | 367/25 |
| 5,091,644 | A | | 2/1992 | Minette | 250/254 |
| 5,160,925 | A | | 11/1992 | Dailey et al. | 340/853.3 |
| 5,313,829 | A | | 5/1994 | Paslay et al. | 73/152.47 |
| 5,358,059 | A | * | 10/1994 | Ho | 175/45 |
| 5,402,677 | A | * | 4/1995 | Paslay et al. | 73/152.43 |
| 5,473,158 | A | | 12/1995 | Holenka et al. | 250/254 |
| 5,475,309 | A | | 12/1995 | Hong et al. | 324/338 |
| 5,501,285 | A | | 3/1996 | Lamine et al. | 175/27 |
| 5,507,353 | A | | 4/1996 | Pavone | 175/27 |
| 5,511,037 | A | | 4/1996 | Randall et al. | 367/33 |
| 5,513,528 | A | | 5/1996 | Holenka et al. | 73/152.03 |
| 5,550,788 | A | | 8/1996 | Pavone et al. | 367/25 |
| 5,565,624 | A | | 10/1996 | Deboaisne et al. | 73/152.02 |
| 5,581,024 | A | | 12/1996 | Meyer, Jr. et al. | 73/152.03 |
| 5,629,623 | A | | 5/1997 | Sezginer et al | 324/303 |
| 5,654,503 | A | | 8/1997 | Rasmus | 73/152.43 |
| 5,663,929 | A | | 9/1997 | Pavone et al. | 367/82 |
| 5,705,927 | A | | 1/1998 | Sezginer et al. | 324/303 |
| 5,720,355 | A | | 2/1998 | Lamine et al. | 175/27 |
| 5,721,376 | A | | 2/1998 | Pavone et al. | 73/152.47 |
| 5,740,036 | A | | 4/1998 | Ahuja et al. | 364/321 |
| 5,748,471 | A | | 5/1998 | Grande | 364/422 |
| 5,842,149 | A | | 11/1998 | Harrell et al. | 702/9 |
| 5,883,583 | A | | 3/1999 | Kishino | 340/853.3 |
| 5,886,303 | A | | 3/1999 | Rodney | 181/102 |
| 5,899,958 | A | | 5/1999 | Dowell et al. | 702/6 |
| 5,923,167 | A | | 7/1999 | Chang et al. | 324/303 |
| 5,947,213 | A | | 9/1999 | Angle et al. | 175/24 |
| 5,987,385 | A | | 11/1999 | Varsamis et al. | 702/6 |
| 6,008,646 | A | | 12/1999 | Griffin et al. | 324/303 |
| 6,023,164 | A | | 2/2000 | Prammer | 324/303 |
| 6,057,784 | A | | 5/2000 | Schaaf et al. | 340/854.4 |
| 6,065,219 | A | | 5/2000 | Murphey et al. | 33/544 |
| 6,081,116 | A | | 6/2000 | Wu et al. | 324/303 |
| 6,109,372 | A | | 8/2000 | Dorel et al. | 175/61 |
| 6,111,408 | A | | 8/2000 | Blades et al. | 324/303 |
| 6,150,822 | A | | 11/2000 | Hong et al. | 324/338 |
| 6,158,529 | A | | 12/2000 | Dorel | 175/61 |
| 6,205,851 | B1 | * | 3/2001 | Jogi | 73/152.47 |

* cited by examiner 18
26
22
22
24
20
14
10
12

ACCELEROMETER CALIPER WHILE DRILLING

BACKGROUND OF THE INVENTION

1. Field of the Invention

This invention relates to an apparatus for use in accurately determining a wellbore caliper. In particular the invention relates to the determination of wellbore caliper while a drilling process is taking place. In a practical embodiment, this is achieved by using a plurality of orthogonally mounted accelerometers.

2. Description of the Related Art

Typically, a wellbore extending through a formation is not straight, but rather extends in a snake-like fashion through the formation. Such wellbores are often of spiraling form resulting from the rotary motion of the drill bit. However, the wellbore may also take other forms, for example, as a result of the drill bit being deflected from its original path as a result of encountering a change in the structure of the formation through which the wellbore is being drilled. Even wellbores which are regarded as being straight often have variations in deviation and direction. Although these variations may be small, they can still be of significance when completing a wellbore. By way of example, it is usual to line a wellbore of 8½" diameter using a casing having an outer diameter of 7". Clearly, if the wellbore is exactly straight, this gives a radial clearance of only ¾". Obviously, where the wellbore is not exactly straight, then there may (be regions where there is less clearance, or regions where the provisions of such a casing is not practical and other lining techniques may need to be used.

In practice, wellbores are very rarely exactly straight, indeed with the advent of steerable drilling systems highly deviated and horizontal wellbores are widely used in order to enhance reservoir production. The positioning of a completion string such as a wellbore casing within such a wellbore can be a very difficult operation and may result in damage to the completion string. Even where the completion string is not damaged, there is an increased likelihood of impaired production rates.

It will be appreciated from the description above that the geometry and orientation of the wellbore, as well as the way a completion string will sit in the wellbore, play a very important part in determining the effectiveness of the completion during clean up, treatment, cementing/isolation, and production.

A number of techniques are known to permit the measurement of wellbore shape. One such technique involves the use of a tool known as a dipmeter which includes sensors arranged to measure variations in the conductivity of the formation. The dipmeter has calipers arranged to measure the size of the wellbore as the dipmeter passes along the length of the wellbore. Other sensors arranged to measure the deviation and direction of the wellbore may also be provided. In use, the dipmeter is passed along the length of the wellbore and readings are taken using the various sensors. The readings are logged along with the position of the dipmeter at the time the readings are taken and this information is subsequently used to produce a three-dimensional image of the wellbore.

Other tools are also known for use in measuring the shape of the wellbore. For example, a tool known as a borehole geometry tool can be used. A tool of this type is similar to a dipmeter but does not include sensors for measuring formation conductivity. Another tool is an ultrasonic borehole imaging (UBI) tool. This tool is used in conjunction with a general purpose inclinometry tool to generate data representative of the wellbore shape and size which data can, if desired, be used to produce a three-dimensional image of the wellbore.

It will be appreciated that knowledge of what is likely to happen downhole as a completion string is inserted into a wellbore is useful in deciding how to complete a wellbore.

Accurate measurement of the wellbore caliper using the above-described devices can only be achieved after drilling. Measurement while drilling is not practical as it is not possible to determine the absolute position of the tool being used to generate the desired data. Further, where a UBI tool is used, the tool must be rotated relatively slowly as the sensitivity of the tool decreases with increasing speed, making the tool unsuitable for use in a measurement while drilling system.

Measurement of a number of drilling parameters while drilling can be achieved. For example, WO99/36801 describes an arrangement for nuclear magnetic resonance (NMR) imaging of a wellbore. Such imaging is useful as it can be used to derive information representative of the porosity, fluid composition, the quantity of moveable fluid and the permeability of the formation being drilled. In order to produce useful data, it is important that the sensor of the arrangement is either stationary or is only moving relatively slowly. Where fast movement is occurring, the results are less useful in determining the values of the parameters as there is an increased risk of significant errors in the results. In order to determine whether or not the NMR readings taken using the tool can be used, the tool is provided with sensors for use in monitoring the motion of the tool. One example of a suitable sensor arrangement is to provide the tool with accelerometers and a suitable control arrangement. The accelerometer readings can be used to produce data representative of the motion of the tool, and the control arrangement can be used to inhibit the production of NMR data when the motion of the tool is such that the NMR readings would be likely to include significant errors. Alternatively, the control arrangement may be arranged to allow the NMR readings to be made to flag the readings that are likely to contain errors.

SUMMARY OF THE INVENTION

According to the present invention there is provided an accelerometer caliper while drilling arrangement comprising a drill bit having an axis of rotation and a gauge region, a caliper tool body, a first accelerometer mounted upon the caliper tool body and arranged to measure acceleration in a first direction, and a second accelerometer mounted upon the caliper tool body and arranged to measure acceleration in a second direction orthogonal to the first direction, wherein the caliper tool body and the drill bit are coupled to one another in such a manner that the first and second accelerometers are mounted in a known relationship to the drill bit.

As the accelerometers are mounted in a known relationship to the drill bit, and as the drill bit defines the edges of the bore, the positions of the accelerometers are known and the acceleration readings taken using the accelerometer can be used to ascertain the shape of the wellbore.

Although as described above, only two orthogonally mounted accelerometers are required, it will be appreciated that if a greater number of accelerometers are provided, then it may be possible to increase the accuracy with which caliper readings can be taken. In a preferred arrangement, three accelerometers are used, but it will be appreciated that the invention is not restricted to arrangements including three accelerometers.

It is thought that the accelerometer caliper while drilling tool will be able to take wellbore caliper diameter measurements with an accuracy of up to about +/−0.06".

If desired, the caliper tool body may form part of the drill bit.

BRIEF DESCRIPTION OF THE DRAWINGS

The invention will further be described, by way of example, with reference to the accompanying drawings, in which.

DETAILED DESCRIPTION OF THE INVENTION AND TIRE PREFERRED EMBODIMENT

Figure 1:
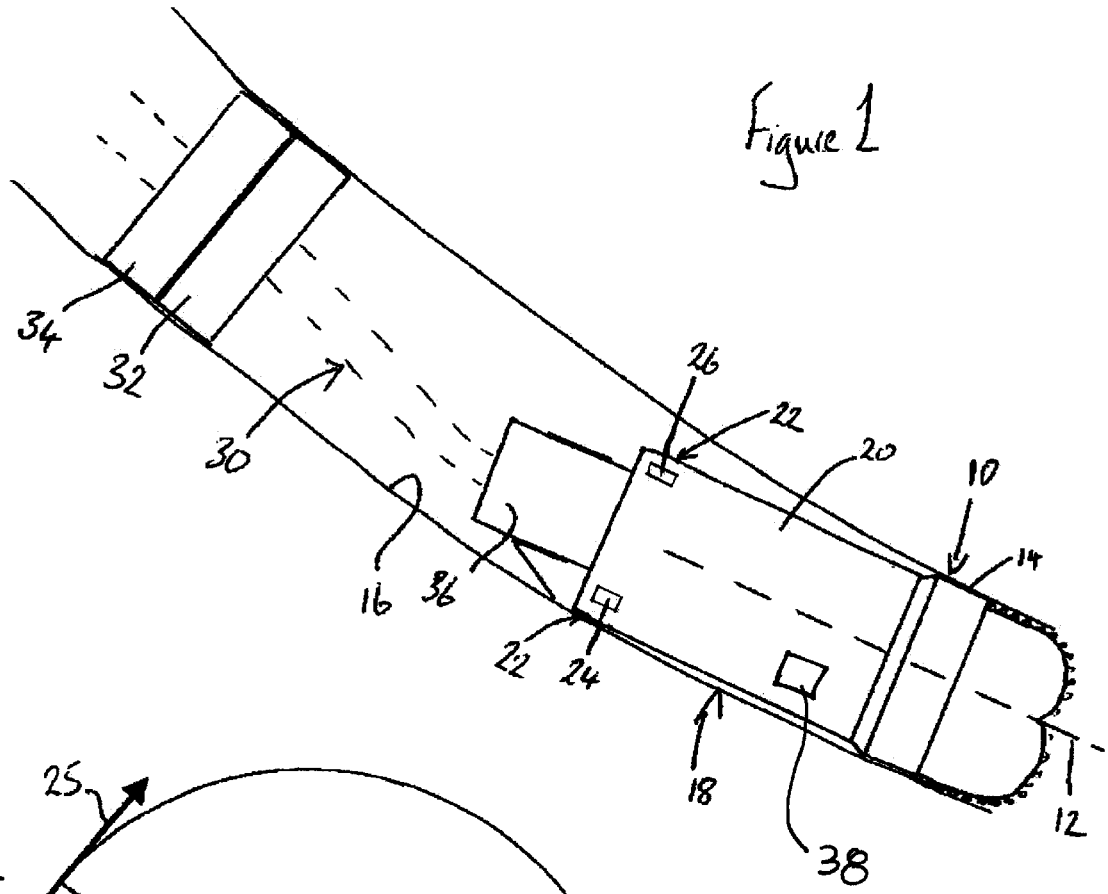
FIG. 1 is a diagrammatic view illustrating a wellbore and bottom hole assembly including an accelerometer caliper while drilling system.

The bottom hole assembly (BHA) illustrated, diagrammatically, in FIG. 1 comprises a drill bit 10 of the rotary drag type which has an axis 12 about which it is rotated, in use, and a gauge region 14. The gauge region bears against the wall 16 of the wellbore, in use.

The drill bit 10 is mounted upon a caliper tool 18 which comprises a body of diameter slightly smaller than the diameter of the gauge region 14 of the drill bit 10. As the body 20 is slightly smaller in diameter than the gauge region 14, it will be appreciated that, when the bottom hole assembly is in a straight part of the wellbore, the tool body 20 is radially spaced from the wall 16 of the wellbore.

Figure 2:
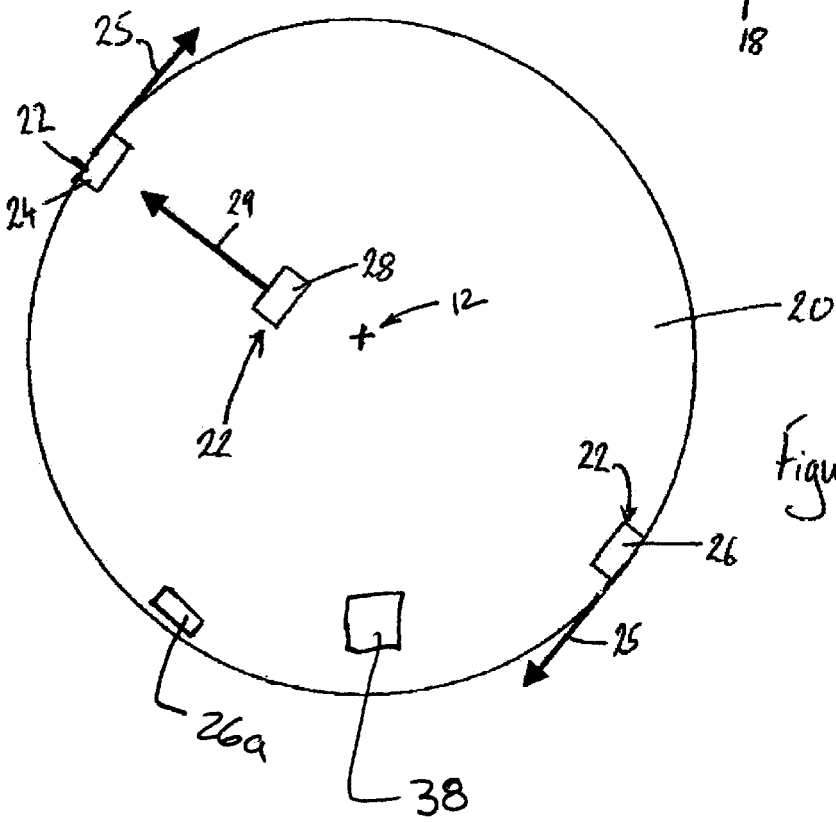
FIG. 2 is a diagrammatic sectional view of part of the caliper while drilling system.

The body 20 has mounted thereon three accelerometers or, acceleration sensors 22. Two of the sensors 22 are mounted at the periphery of the body 20 and lie upon a diameter of the body 20. These two sensors are denoted by the reference numerals 24, 26. It will be appreciated from FIG. 2 that preferably these sensors 24, 26 are oppositely orientated with respect to the longitudinal axis 12 relative to one another and a sensitive to lateral acceleration of the body 20 in a first direction 25, and to be sensitive to angular acceleration of the tool body 20. Although it is preferred to oppositely mount sensors 24, 26 it would be appreciated that other mounting orientations are also possible, as indicated by numeral 26*a*, and in certain applications, these alternate orientations may be useful. The third sensor, denoted by reference numeral 28, is orientated to measure lateral acceleration in a direction 29 perpendicular to, or orthogonal to, the first direction 25 in which the sensors 24, 26 are sensitive to lateral acceleration.

The tool body 20 is connected to a drill string 30 which supports the bottom hole assembly. If desired, the bottom hole assembly may include a number of other components. For example, it may include a stabilizer 32, a mud pulse telemetry transmitter 34 and where the system of which the bottom hole assembly fobs part takes the form of a steerable drilling system then the bottom hole assembly may include a bias unit 36 arranged to apply a side loading to the drill bit 10 to cause the formation of a curve in the wellbore (as shown), or it may include a downhole motor for rotating the drill bit, and a bent component positionable, by controlling the angular position of the drill string, to control the direction in which drilling is taking place.

In use, while drilling is taking place, the caliper tool 18 is controlled in such a manner as to produce, sensor readings representative of the accelerations experienced by the tool 18. By double integration of the sensor readings, the sensor readings can be converted into data representative of the radial position of the tool 18 relative to the wall 16 of the wellbore.

As the tool 18 is physically secured to the drill bit 10, the positions of the accelerometers 24 relative to the drill bit 10 are known and fixed. If the position of the wall 16 relative to the sensors is known, and the positions of the sensors are known, then the absolute position and shape of the wall 16 of the wellbore can be determined.

The drill bit 10 should normally lie substantially on the axis of the part of the bore being drilled. As described hereinbefore, where the wellbore is straight, the tool 18 should not engage the wall 16 of the wellbore, and so any acceleration of the tool body should be as a result of instructions modifying the drilling parameters, for example changing the direction of drilling, and as these accelerations are expected, they can be accounted for and can, if desired, be used to monitor the effect of alteration of the drilling parameters. If the bottom hole assembly is not located within a straight part of the bore, then the tool body 20 may move into contact with the wall of the borehole. In these circumstances, the sensors will produce signals representative of the accelerations experienced by the tool 18 occurring as a result of the tool body 20 colliding or otherwise engaging with the wall of the wellbore.

In practice, the formation of straight parts of a wellbore occurs relatively infrequently as the rotary motion of the drill bits tends to result in the formation of wellbores of spiral form, and these spiraling wellbores are often regarded as being 'straight', even though completion of these parts of the wellbore may be complicated due to their shape. The apparatus described hereinbefore can be used to monitor the formation of these spiraling parts of the wellbore, and the data derived used in determining how completion can best be effected.

As mentioned above, the acceleration readings are double integrated to produce data representative of the positions of the sensors 22 at the time that the accelerations were sensed. As the positions of the sensors 22 are fixed relative to the drill bit, and as some information about the position of the drill bit is known, for example the distance downhole of the drill bit and the fact that it lies on the axis of the wellbore, a three-dimensional image of the wellbore can be derived. Since the drill bit 10 creates and defines the wall 16 of the wellbore as the bit drills, dimensional information of the wall 16 (i.e. the caliper) is readily determined knowing the position information gained from the sensors 22, and the geometrical relationship between the sensors and the drill bit 10.

In order to orient the three-dimensional information wall 16 of the wellbore properly in space, other information required. If the wellbore is not vertical, the constant acceleration due to gravity can be derived from the sensor signals. This information is used to align the three-dimensional image angularly, with respect to the longitudinal axis of the wellbore. If the wellbore is vertical, a magnetometer 38 may, be used to angularly align the three-dimensional image. The three-dimensional image must also be located properly along the length of the drill string. This is readily accomplished by monitoring the distance downhole of the drill bit.

The caliper tool 18 may be operated in several ways. In a simple mode of operation, the caliper tool 18 may simply store the acceleration readings for subsequent interpretation once the tool 18 has been returned to the surface. Alternatively, the tool may be arranged to process the data to determine the shape of the bore as the readings are being made. In either case, if desired, the tool 18 may be connected to a system for transmitting data, either in its raw form or its processed form, to the surface to enable an operator to see the shape of the wellbore while the tool 18 is within the wellbore. Typically, such transmission of data could be performed using a mud pulse telemetry technique and the transmitter 34.

In order to reduce the quantity of data that must be stored or transmitted, the apparatus may be designed or controlled in such a manner as to permit sensor readings to be taken relatively infrequently where it is sensed that the wellbore is relatively straight or where the tool occupies a portion of the wellbore of little interest to the operator, the frequency of taking readings, and hence the quality of the data resolution, increasing when it is sensed that the tool occupies a non-straight portion of the wellbore or the tool is located within a portion of the wellbore of greater interest to the operator.

Figure 3:
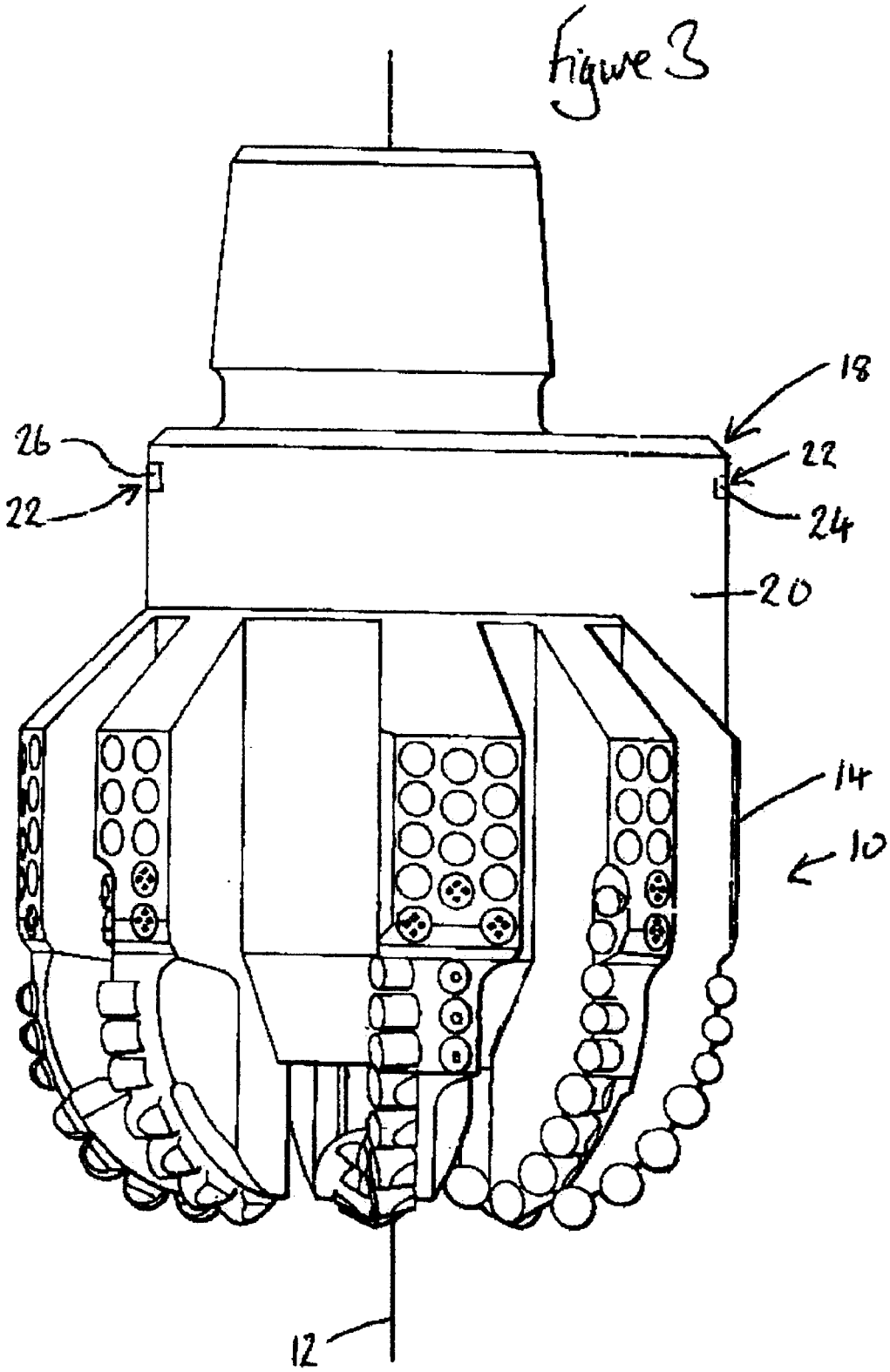
FIG. 3 is a diagrammatic view of part of an alternative bottom hole assembly.

Although in the description hereinbefore the tool body 20 is of diameter and position such that it does not engage the wellbore when the bottom hole assembly is located within a straight part of the wellbore, this need not be the case. If desired, the tool body could be designed in such a manner as to promote engagement between the tool body and the wall of the wellbore in order to increase the number of positive accelerometer readings. For example, the tool body 20 could be located eccentrically relative to the axis of the drill bit as shown in FIG. 3. In such circumstances, the shape and position of the tool body must be taken into account when interpreting the sensor readings.

In a modification, rather than mounting the acceleration sensors 22 on a separate caliper tool body 20 secured to the drill bit 10, the caliper tool body 20 may form part of the drill bit 10 (also as shown in FIG. 3).

Whereas the present invention has been described in particular relation to the drawings attached hereto, it should be understood that other and further modifications apart from those shown or suggested herein, may be made within the scope and spirit of the present invention.

What is claimed is:

1. An accelerometer caliper while drilling device comprising a drill bit having an axis of rotation and a gauge region, a caliper tool body, a first accelerometer mounted upon the caliper tool body and arranged to measure acceleration in a first direction, and a second accelerometer mounted upon the caliper tool body and arranged to measure acceleration in a second direction orthogonal to the first direction, wherein the caliper tool body and the drill bit are coupled to one another in such a manner that the first and second accelerometers are mounted in a known relationship to the drill bit.

2. The accelerometer caliper while drilling device of claim 1, wherein an additional accelerometer is mounted upon the caliper tool body.

3. The accelerometer caliper while drilling device of claim 2, wherein the additional accelerometer is mounted diametrically opposite the first accelerometer.

4. The accelerometer caliper while drilling device of claim 1, wherein at least one of the accelerometers is located at a periphery of the caliper tool body.

5. The accelerometer caliper while drilling device of claim 1, wherein the caliper tool body is located eccentrically relative to the drill bit.

6. The accelerometer caliper while drilling device of claim 1, further comprising a magnetometer.

7. The accelerometer caliper while drilling device of claim 2, wherein the cailper tool body is located eccentrically relative to the drill bit.

8. A bottom hole assembly comprising a drill bit having an axis of rotation and a gauge region, an accelerometer caliper tool body, a first accelerometer mounted upon the caliper tool body, and arranged to measure acceleration in a first direction, and a second accelerometer mounted upon the caliper tool body and arranged to measure acceleration in a second direction orthogonal to the first direction, wherein the caliper tool body and the drill bit are coupled to one another in such a manner that the first and second accelerometers are mounted in a known relationship to the drill bit, a controller/processor arranged to receive signals from the first and second accelerometers and a mud telemetry transmitter arranged to transmit data under the control of the controller/processor.

9. The bottom hole assembly of claim 8, further comprising a magnetometer.

* * * * *